US006729911B1

(12) United States Patent
Hu

(10) Patent No.: US 6,729,911 B1
(45) Date of Patent: May 4, 2004

(54) AV TERMINAL

(76) Inventor: Chia-Hui Hu, No.201, Fude 1st Rd., Shijr City, Taipei Hsien (TW)

( * ) Notice: Subject to any disclaimer, the term of this patent is extended or adjusted under 35 U.S.C. 154(b) by 0 days.

(21) Appl. No.: 10/325,918

(22) Filed: Dec. 23, 2002

(51) Int. Cl.[7] ..... H01R 33/20
(52) U.S. Cl. ..... 439/675; 439/578; 439/63
(58) Field of Search ..... 439/675, 578, 439/63

(56) References Cited

U.S. PATENT DOCUMENTS 5,044,990 A * 9/1991 Knotts ..... 439/63
5,046,952 A * 9/1991 Cohen et al. ..... 439/63
5,439,394 A * 8/1995 Ikeda ..... 439/675
6,309,250 B1 * 10/2001 Hyzin ..... 439/675

* cited by examiner

*Primary Examiner*—Tho D. Ta
(74) *Attorney, Agent, or Firm*—Birch, Stewart, Kolasch & Birch, LLP

(57) ABSTRACT

An AV (audiovisual) terminal includes a fixed jack and a plug. The present invention features on that a plurality of longitudinal slots arranged annularly on a sleeve of the plug so as to form a plurality of elastic conductive clipping pieces. An outer bushing is disposed outside the sleeve so that the elastic conductive clipping pieces of the plug hold the conductive post for preventing the deformation of the elastic conductive clipping pieces when the plug is joined with the fixed jack.

1 Claim, 5 Drawing Sheets

AV TERMINAL

BACKGROUND OF THE INVENTION

1. Field of the Invention

The present invention relates to an AV(audiovisual) terminal, especially to a sleeve on the plug of the conductive wire of the AV terminal with a plurality of longitudinal slots arranged annularly and a plurality of elastic conductive clipping pieces. An outer bushing is disposed outside the sleeve so that the elastic conductive clipping pieces of the plug clips on the conductive post. And the outer bushing can also restrain the elastic conductive clipping pieces so as to avoid the deformation of the clipping pieces.

Conventional televisions, video tape recorders, LD drivers, stereos, speakers, amplifiers . . . and so on, the input or output of the video or sound signals is most by signal connectors—general called AV terminal. By cables, the AV terminal is connected with the above mentioned electrical appliances for signal transmitting.

General signal connector is composed of a jack and a plug. The plug is the foresaid AV terminal. The jack is disposed on the circuit board of the electrics while the plug is arranged on two ends of the wire. Therefore, by the plug of the wires connecting with the jack on the electrics, the two audio/video equipment are joined for transmitting signals.

Refer to FIG. 4, a conventional jack (a) includes an insertion hole (a2) disposed on top end of a post (a1). There is insulation between the insertion hole (a2) and the post (a1) so as to avoid short when the insertion hole (a2) and the post (a1) are connected to the circuit board (not shown in figure) respectively. A plug (b) is composed by a sleeve (b1) with an inner insertion post (b2) on the center thereof. There is also insulation between the sleeve (b1) and the inner insertion post (b2) which connects to wires respectively (not shown in figure). The sleeve (b1) of the plug (b) covers the post (a1) of the plug (a1) while the inner insertion post (b2) of the plug (b) is inserted into the insertion hole (a2) of the jack (a) so that the plug (b) joins with the jack (a) for connecting the wires to the jacks (a) on the electrical appliance.

However, the plugs (a) fixed on electrical appliances are different due to different brands and manufactures. The wires are always attached with the electrical appliances. During the manufacturing process, there are always problems regarding the tolerance. If the minimum inner diameter of the jack (a) manufactured by one company is larger than the maximum outer diameter of the plug (b) manufacture by another company, the plug (b) can't be connected with the jack (a) firmly. On the contrary, the maximum inner diameter of the jack (a) manufactured by one company is far smaller than the minimum outer diameter of the plug (b) manufacture by another company, the plug (b) can't be inserted into the jack (a).

Although there is a standard specification for tolerance, it's difficult to avoid the above situations. In addition, the inner diameter of the sleeve (b1) of the plug (b) is fixed size. After long term usage, the plug (b) may have bad contact with the jack (a) due to abrasion so that the signal transmission of the video and sound is also influenced.

In order to improve the drawback of the foresaid plug (b), refer to FIG. 5, there is another embodiment of a prior art. A plurality of threadlike slots (b11) arranged annularly on the sleeve (b1) of the plug (b). The sleeve (b1) of the plug (b) is elastic so that it can hold the post (a1) of the jack (a).

However, when such kind of elastic plug (b) is pulled out, even a bit bias makes the opening of the sleeve (b1) deformation. Thus the sleeve (b1) can't fasten firmly on the post (a1) of the jack (a). If the plug (b) is loose, such design is easy to have bad contact.

SUMMARY OF THE INVENTION

It is therefore a primary object of the present invention to provide an AV terminal having a plurality of longitudinal slots arranged annularly on a sleeve of the plug so as to form a plurality of elastic conductive clipping pieces. An outer bushing is disposed outside the sleeve so that when the elastic conductive clipping pieces of the plug holds on the conductive post, the bushing presses the elastic conductive clipping pieces so as to avoid the deformation of the clipping pieces.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DETAILED DESCRIPTION OF THE PREFERRED EMBODIMENT

Figure 1:
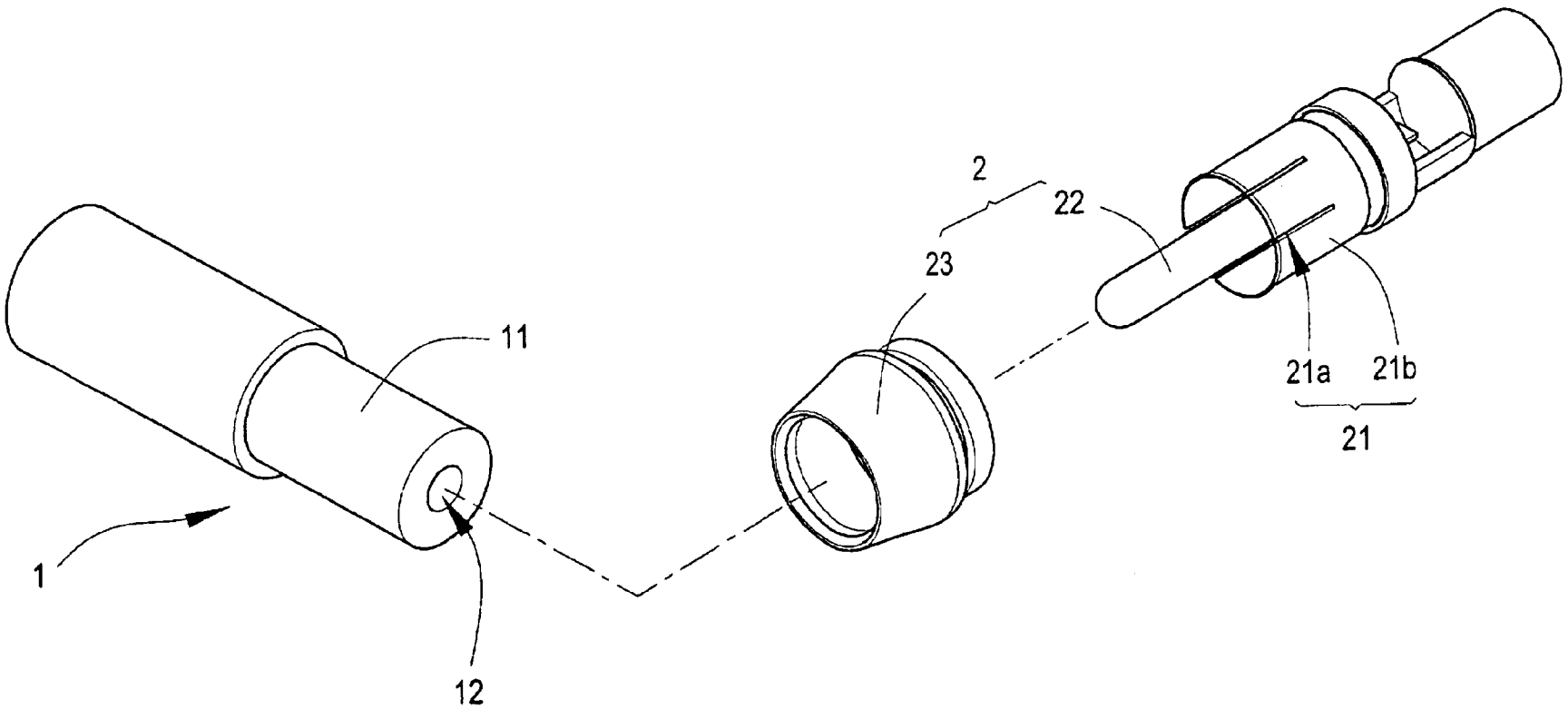
FIG. 1 is an exploded view of the present invention.
Figure 2:
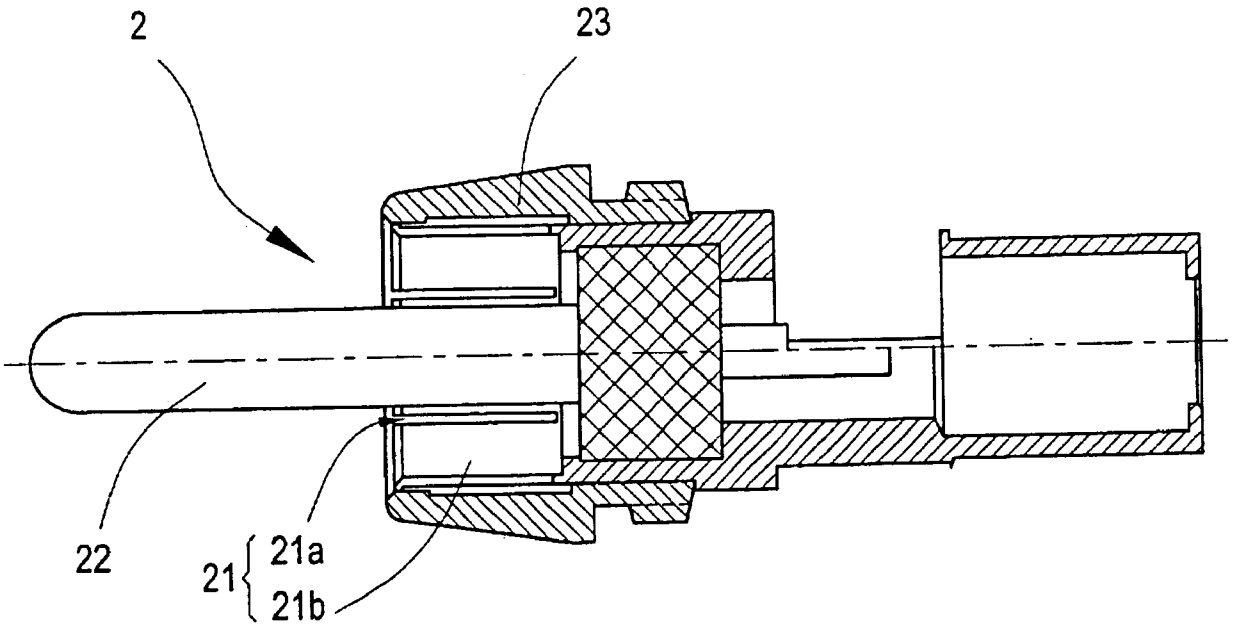
FIG. 2 is a sectional view of the present invention.

Refer to FIG. 1 and FIG. 2, the present invention includes a fixed jack (1) and a plug (2). The fixed jack (1) is composed of a conductive post (11) and a conductive insertion hole (12) disposed on the top of the conductive post (11). There is insulation between the conductive insertion hole (12) and the post (11); the conductive insertion hole (12) as well as the conductive post (11) is connected to the circuit board (not shown in figure) respectively. As to the plug (2) includes an insertion rod (22) arranged on the center of a sleeve (21). There is also insulation between the sleeve (21) and the insertion rod (22) to make them connect to wires respectively. When being assembled, the sleeve (21) of the plug (2) holds the conductive post (11) of the fixed jack (1) and the insertion rod (22) of the plug (2) inserts into the conductive insertion hole (12) of the fixed jack (1) so as to connect the plug (2) to the fixed jack (1). The invention is characterized in that:

a plurality of longitudinal slots (21*a*) is disposed annularly on the sleeve (21) of the plug (2) thus a plurality of elastic conductive clipping pieces (21*b*) formed on the sleeve (21). A bushing (23) covers outside the sleeve (21) so as to prevent the deformation of the elastic conductive clipping pieces (21*b*) when the plug (2) is joined with the fixed jack (1) by the elastic conductive clipping pieces (21*b*) of the sleeve (21) holding the conductive post (11) of the fixed jack (1) annularly.

In accordance with the structure mentioned above, when the plug (2) inserts into the conductive insertion hole (12) on the conductive post (11) of the fixed jack (1), the elastic conductive clipping pieces (21*b*) of the sleeve (21) covers the conductive post (11) of the fixed jack (1) annularly so that the sleeve (21) of the plug (2) contact the post (11) of the fixed jack (1) to form a circuit.

Moreover, the bushing (23) presses the elastic conductive clipping pieces (21*b*) so as to avoid the bias of the elastic conductive clipping pieces (21*b*) while bending outwardly. Thus the bad contact caused by the deformation of the elastic conductive clipping pieces (21*b*) can also be prevented.

Furthermore, even the deviation of manufacturing is quite large, by the elastic conductive clipping pieces (21*b*) covering the conductive post (11) closely, the bad contact can be avoided.

Due to the elasticity of the conductive clipping pieces (21*b*) of the sleeve (21), there is more flexibility for the sleeve (21) to accommodate the fixed jack (1) of other brands. Thus the present invention is more convenient than prior art.

When the elastic conductive clipping pieces (21*b*) is worn out, they can still clip on the conductive post (11) due to the elasticity of themselves. Thus the bad contact can be avoided.

Figure 3:
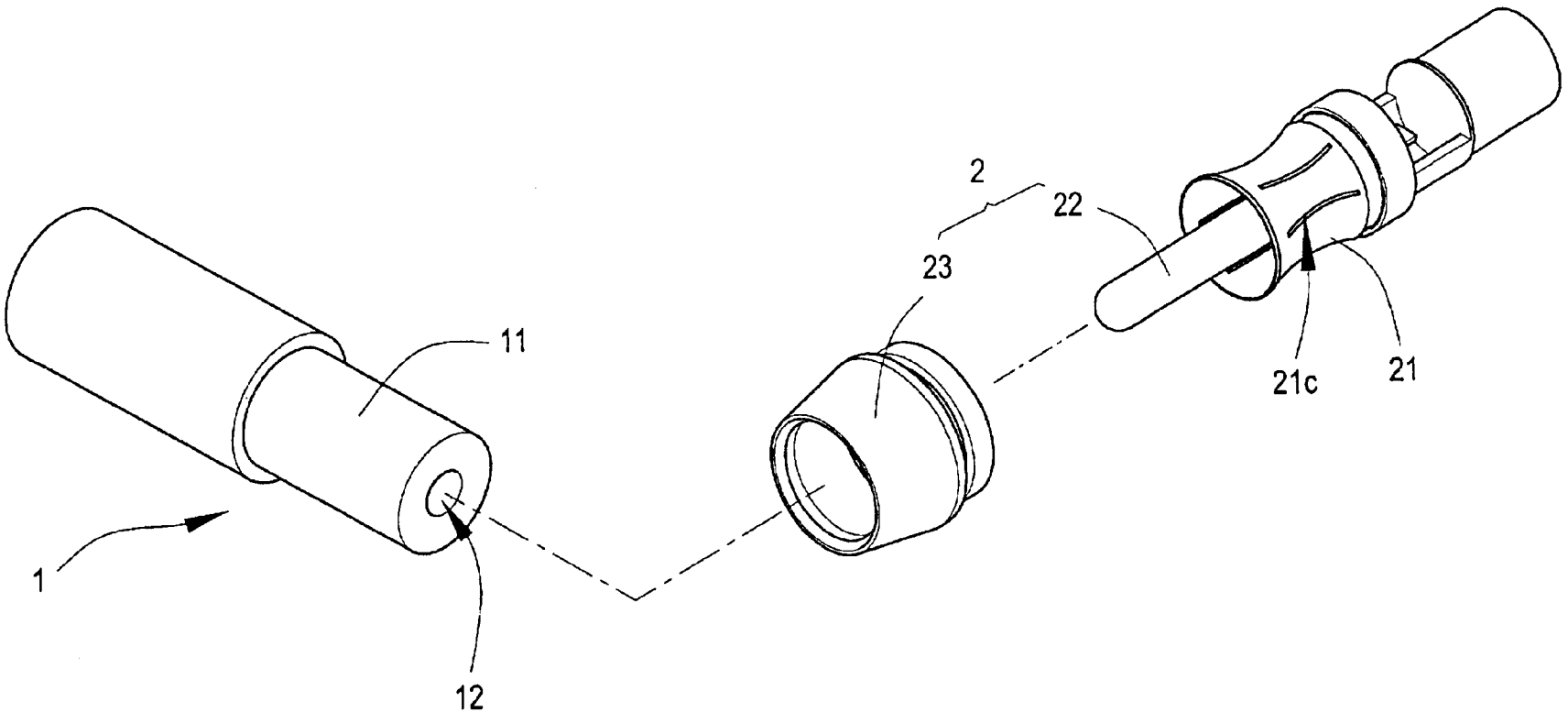
FIG. 3 is an exploded view of another embodiment of the present invention.
Figure 4:
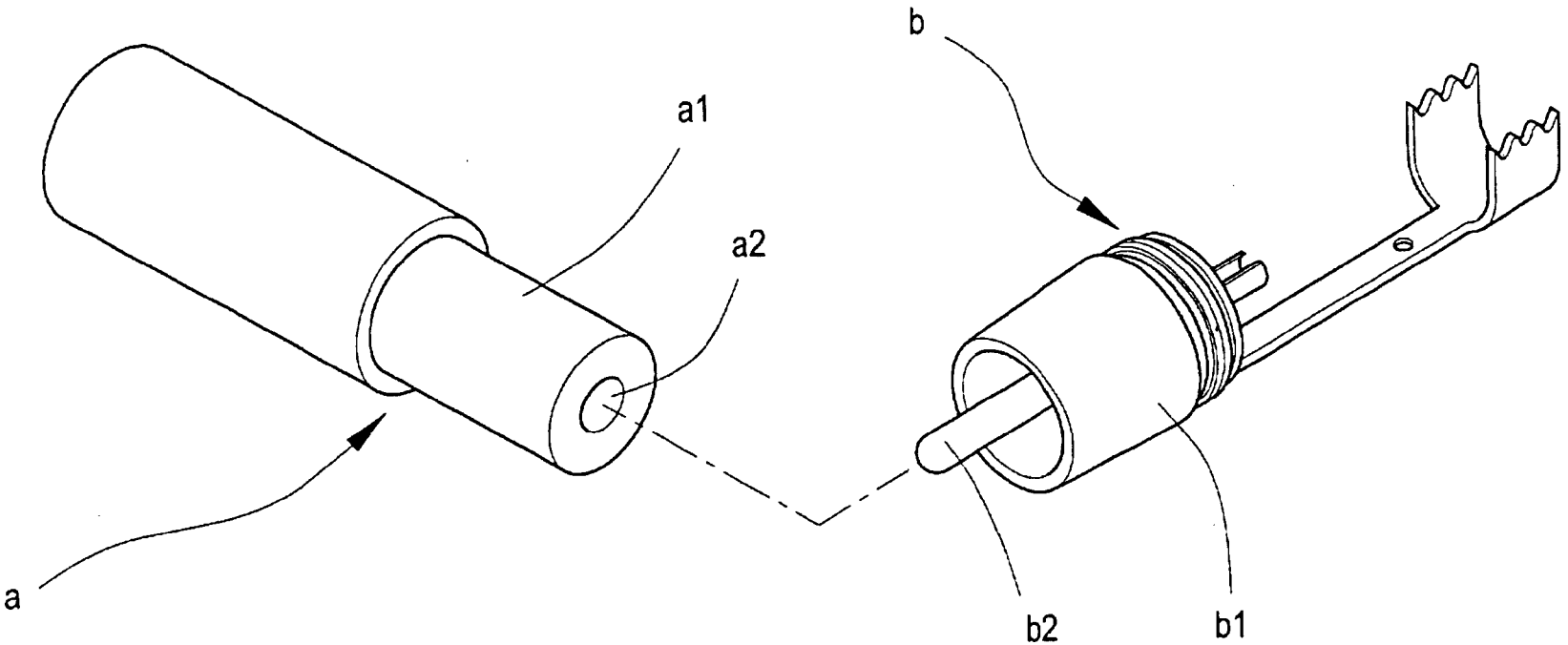
FIG. 4 ( PRIOR ART )
FIG. 4 is an exploded view of a prior art.
Figure 5:
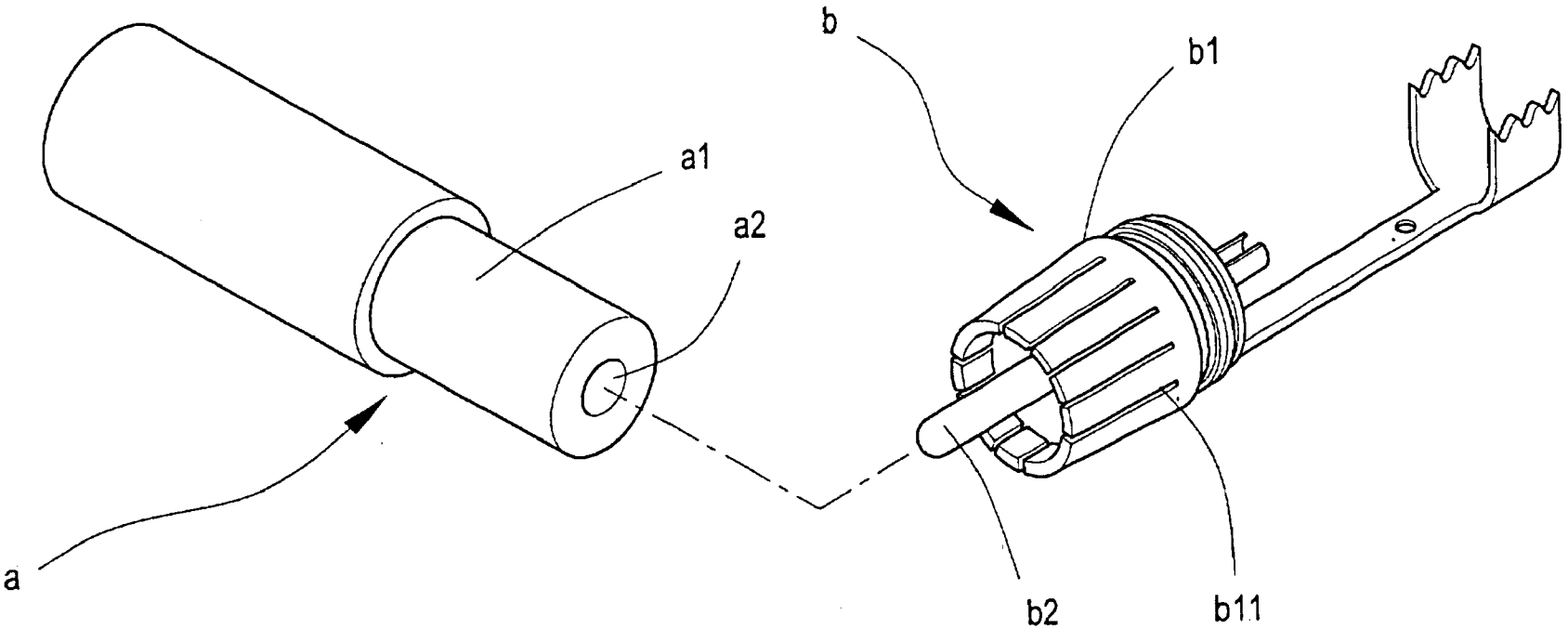
FIG. 5 ( PRIOR ART )
FIG. 5 is an exploded view of a further prior art.

Refer to Fig.3, a plurality of longitudinal slots (21*a*) disposed annularly on the sleeve (21) of the plug (2) can be designed into a long groove (21*c*). And the sleeve (21) also has elasticity. This is another embodiment of the present invention.

It should be noted that the above description and accompanying drawings are only used to illustrated some embodiments of the present invention, not intended to limit the scope thereof. Any modification of the embodiments should fall within the scope of the present invention.

What is claimed is:

1. An AV terminal, comprising:

a fixed jack having a conductive post and a conductive insertion hole disposed on the top of and extending into said conductive post, with insulation between said conductive insertion hole and said conductive post, said conductive insertion hole and said conductive post being connected to a circuit board;

a plug having an insertion rod arranged at a center of a sleeve, with insulation between said sleeve and said insertion rod, said sleeve and said insertion being connected to wires;

said sleeve receiving said conductive post of said fixed jack and said conductive insertion hole of said fixed jack receiving said insertion rod of said plug, so as to connect said plug to said fixed jack;

a plurality of longitudinal slots disposed annularly on the sleeve of the plug so as to form a plurality of elastic conductive clipping pieces on said sleeve; and a bushing covering outside of said sleeve and pressing the elastic conductive clipping pieces to prevent the deformation of said elastic conductive clipping pieces when said plug connects with said fixed jack, said elastic conductive clipping pieces holding said conductive posts annularly.

* * * * *